US008770169B2

(12) United States Patent
Koyama

(10) Patent No.: US 8,770,169 B2
(45) Date of Patent: Jul. 8, 2014

(54) COVER MEMBER TO ENGINES

(75) Inventor: Yoshiaki Koyama, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 292 days.

(21) Appl. No.: 12/677,244

(22) PCT Filed: Aug. 22, 2008

(86) PCT No.: PCT/JP2008/002280
§ 371 (c)(1),
(2), (4) Date: Mar. 9, 2010

(87) PCT Pub. No.: WO2009/034685
PCT Pub. Date: Mar. 19, 2009

(65) Prior Publication Data

US 2010/0192902 A1 Aug. 5, 2010

(30) Foreign Application Priority Data

Sep. 10, 2007 (JP) ..... 2007-234474

(51) Int. Cl.
*F02B 77/13* (2006.01)
*F02B 77/11* (2006.01)

(52) U.S. Cl.
USPC ..... 123/195 C; 123/198 E; 181/290; 181/291; 181/286; 181/269

(58) Field of Classification Search
USPC ..... 123/198 E, 195 A, 195 D, 195 C; 181/204, 286, 269, 290–291; 29/509, 29/505, 243, 5; 52/177; 404/21, 19
See application file for complete search history.

(56) References Cited

U.S. PATENT DOCUMENTS

| | | | | | |
|---|---|---|---|---|---|
| 4,411,121 | A * | 10/1983 | Blacklin et al. | ..... | 52/789.1 |
| 4,445,584 | A * | 5/1984 | Kimura et al. | ..... | 180/69.22 |
| 5,692,953 | A * | 12/1997 | Bell et al. | ..... | 454/146 |
| 7,934,354 | B2 * | 5/2011 | Uto | ..... | 52/784.1 |
| 2001/0049978 | A1 * | 12/2001 | Iwata et al. | ..... | 74/606 R |
| 2007/0169991 | A1 * | 7/2007 | Bertsch | ..... | 181/290 |

FOREIGN PATENT DOCUMENTS

| | | | | | |
|---|---|---|---|---|---|
| CN | 1329209 | A | | 1/2002 | |
| JP | 2003-245725 | A | * | 9/2003 | ..... B21D 22/08 |

* cited by examiner

*Primary Examiner* — Lindsay Low
*Assistant Examiner* — Kevin Lathers
(74) *Attorney, Agent, or Firm* — Arent Fox LLP

(57) ABSTRACT

Provided is a cover member (7) such as chain cover member for engines, configured to reduce significantly its own vibrations and noises generated or transmitted therefrom compared to other conventional cover members. On its central portion, the cover member (7) of the present invention is provided with circular compartments (17) each defined by a concave surface facing outward and a convex surface facing inward. At least, the concave surfaces facing outward jointly define a continuous curved surface. Therefore, the flat surfaces (flat portions) on the cover member (7) decrease, thereby reducing sound emission, and thus noises from the cover member (7). In addition, when the cover member (7) of the present invention has at least three circular compartments (17), in each three circular compartments (17) adjoining to each other, the three circular compartments (17) are arranged in a triangular pattern, and each one of them circumscribe the other two circular compartments (17). Therefore, the at least three circular compartments (17) can be arranged in the densest pattern on the cover member (7), and thus flat portions (18) each surrounded by three circular compartments (17) can be minimized, thereby reducing sound emission from the cover member (7).

10 Claims, 6 Drawing Sheets

COVER MEMBER TO ENGINES

CROSS-REFERENCE TO RELATED APPLICATION

This application is a National Stage entry of International Application No. PCT/JP2008/002280, having an international filing date of Aug. 22, 2008; which claims priority to Japanese Application Nos.: 2007-234474, filed Sep. 10, 2007, the disclosures of each of which is hereby incorporated in its entirety by reference.

TECHNICAL FIELD

The present invention relates to a cover member configured to be fixed to an engine so as to cover an endless power transmitting member which transmits rotation of a crankshaft to a driven shaft.

BACKGROUND OF THE INVENTION

In some of conventional vehicle engines, a camshaft and other accessories are driven by power transmitted from a crankshaft. In a power transmitting structure of these engines, an axial end of the crankshaft protrudes from a cylinder block and is fixed to a sprocket or pulley. A driven member such as camshaft is also fixed to a sprocket or pulley. Both of the sprockets or pulleys are engaged with a chain or a belt. In addition, the chain or belt is covered by a cover member (chain cover member or belt cover member, hereinafter chain cover member) fixed to an engine end in an axial direction of the crankshaft.

However, the chain cover member resonates with vibrations of the crankshaft and also transmits outside noises generated by the chain (or belt), and thus it is desired to reduce such noises transmitted from the chain cover member. In order to overcome this problem, there has been developed a chain cover member having a number of polygonal concave surfaces or convex surfaces formed on its surface to reduce vibrations (for example, see Japanese Patent No. 3412759).

Although the configuration of the chain cover member described above achieved the reduction of vibrations, it is likely to generate sound emission through resonance due to flat portions remaining in the concaves or convex surfaces. Therefore, it is desired to reduce sound emission from the cover member more significantly.

BRIEF SUMMARY OF THE INVENTION

In view of such problems of the prior art, the present invention was conceived to reduce vibrations and noises generated or transmitted by a cover member fixed to an engine, such as chain cover member. To achieve this object, the present invention provides a cover member (7) configured to be fixed to an engine (1) so as to cover an endless power transmitting member (14) transmitting rotation of a crankshaft (6) to a driven shaft (13), comprising circular compartments (17) defined on an outer surface (7*a*) of the cover member (7) facing outward with respect to the engine (1), wherein the circular compartments (17) are each formed with a concave or convex surface, the concave or convex surfaces jointly defining a continuous curved surface.

The cover member (7) of the present invention may further comprise a rib (19) provided on an inner surface (7*b*) thereof so as to extend across at least partly across the circular compartments (17). In addition, each circular compartment (17) may be defined by a concave surface facing outward and a convex surface facing inward, the convex surfaces jointly defining a continuous curved surface, and the rib (19) may extend at an angle with respect to a plumb line when the engine (1) is mounted on a vehicle. In addition, the circular compartments (17) include at least three circular compartments (17) which circumscribe one another. Moreover, the cover member (7) may be made by using a die assembly and may further comprise a pushpin boss (21) on a portion surrounded by the at least three circumscribing circular compartments (17) for removing the cover member (7) from the die assembly. Furthermore, a wall of the cover member defining each circular compartment (17) may have a uniform thickness.

The present invention also provides a cover member (7) configured to be fixed to an engine (1) so as to cover an endless power transmitting member (14), wherein the outer surface (7*a*) of the cover member (7) facing outward with respect to the engine (1) is provided with a part (7*c*) that is generally curved substantially laterally across an entire width of the cover member (7) at a radius of curvature (R) greater than the width (b) of the cover member (7), and circular compartments (17) formed with concave or convex surfaces jointly defining a continuous curved surface are formed in the generally curved part (7*c*) of the cover member (7).

In addition, each circular compartment (17) may be defined by a concave surface facing outward and a convex surface facing inward, and the convex surfaces may jointly define a continuous curved surface. In addition, the circular compartments (17) may include at least three circular compartments (17) which circumscribe one other. Moreover, the cover member (7) may be made using a die assembly and may further comprise a pushpin boss (21) on a portion surrounded by the at least three circumscribing circular compartments (17) for removing the cover member (7) from the die assembly. Furthermore, a wall of the cover member defining each circular compartment (17) has a uniform thickness.

According to the first aspect of the present invention, as the circular compartments defined on the outer surface of the cover member are each formed with a concave or convex surface, and the concave or convex surfaces jointly define a continuous curved surface, the area of flat surface (flat portion) on the cover member decreases, thereby reducing sound emission, and thus noises from the cover member.

According to the second aspect of the present invention, as the rib is provided on the inner surface of the cover member so as to extend across the circular compartments, the wall of the cover member defining each circular compartments formed with a concave or convex surface can be reinforced, thereby reducing noises from the cover member. According to the third aspect of the present invention, as the rib is provided so as to extend at least partly across the circular compartments, even when oil flowing down the inner surface of the cover accumulates on the rib extending at an angle with respect to a plum line when the engine is mounted on a vehicle, it will flow to and over the circular compartments to finally drip into the oil storing member (oil pan). Therefore, there is no risk of reducing oil recovery by providing the rib.

According to the fourth aspect of the present invention, as the at least three circular compartments circumscribe one other, the concave surfaces or the convex surfaces of the circular compartments can be arranged in the densest pattern with a minimum flat surface remaining between them, thereby reducing sound emission from the cover member. In addition, if the pushpin boss, which is used for pressing pushpin thereon to remove the cover member from a die assembly used to make the cover member, is provided on one of the curved concave surfaces or convex surfaces of the circular compartments (17), a load applied from the pushpin would be divided into components acting in directions other than the direction in which the cover member is to be removed, and thus it would be difficult to remove the cover member from the die assembly. Therefore, according to the fifth aspect of the present invention, by providing the pushpin boss on the flat portion surrounded by the at least three circular compartments, the load applied on the pushpin can be prevented from being divided into components, and thus the cover member can be readily removed from the die assembly. Therefore, a cover member having at least three circular compartments arranged in a manner that reduces sound emission can be easily made by using a die assembly. According to the sixth aspect of the present invention, by forming the wall of the cover member defining each circular compartment so as to have a uniform thickness, the weight of the cover member will not increase by providing the concave surfaces or convex surfaces. In addition there will be no partial reduction in strength of the cover member, thereby enhancing the reduction of vibrations and sound emission from the cover member.

According to the seventh aspect of the present invention, as the outer surface of the cover member is provided with a part that is curved substantially laterally across an entire width of the cover member, the stiffness of the cover member will increase, thereby reducing sound emission. In addition, by forming the circular compartments on this curved part, sound emission can be reduced even more.

According to the eighth aspect of the present invention, as each circular compartment formed on the curved part is defined by a concave surface facing outward and a convex surface facing inward, the engine length in the axial direction of the crankshaft can be reduced comparing to a cover member having circular compartments each defined by a convex surface facing outward or another one lacking such a circular compartment. This ensures a space necessary for removing the cover member, for example during a maintenance work, while enables other members to be disposed in proximity to the cover member at the same time, thereby easing layout constraints.

According to the ninth aspect of the present invention, as the at least three circular compartments circumscribe one another, the circular compartments can be arranged in the densest pattern with a minimum flat surface remaining between them. This reduces sound emission. In addition, if the pushpin boss, which is used for pressing pushpin thereon to remove the cover member from a die assembly used to make the cover member, is provided on one of the curved concave surfaces or convex surfaces of the circular compartments, a load applied from the pushpin would be divided into components acting in directions other than the direction in which the cover member is to be removed, and thus it would be difficult to remove the cover member from the die assembly. Therefore, according to the tenth aspect of the present invention, by providing the pushpin boss on the flat portion surrounded by the three circular compartments, the load applied from the pushpin can be prevented from being divided into components, and thus the cover member can be readily removed from the die assembly. Therefore, a cover member having at least three circular compartments arranged in a manner that reduces sound emission can be easily made by using a die assembly. According to the eleventh aspect of the present invention, by forming the wall of the cover member defining each circular compartment so as to have a uniform thickness, the weight of the cover member will not increase by providing the concave surfaces or convex surfaces. In addition there will be no partial reduction in strength of the cover member, thereby enhancing the reduction of vibrations and sound emission.

DETAILED DESCRIPTION OF THE PREFERRED EMBODIMENTS

Figure 1:
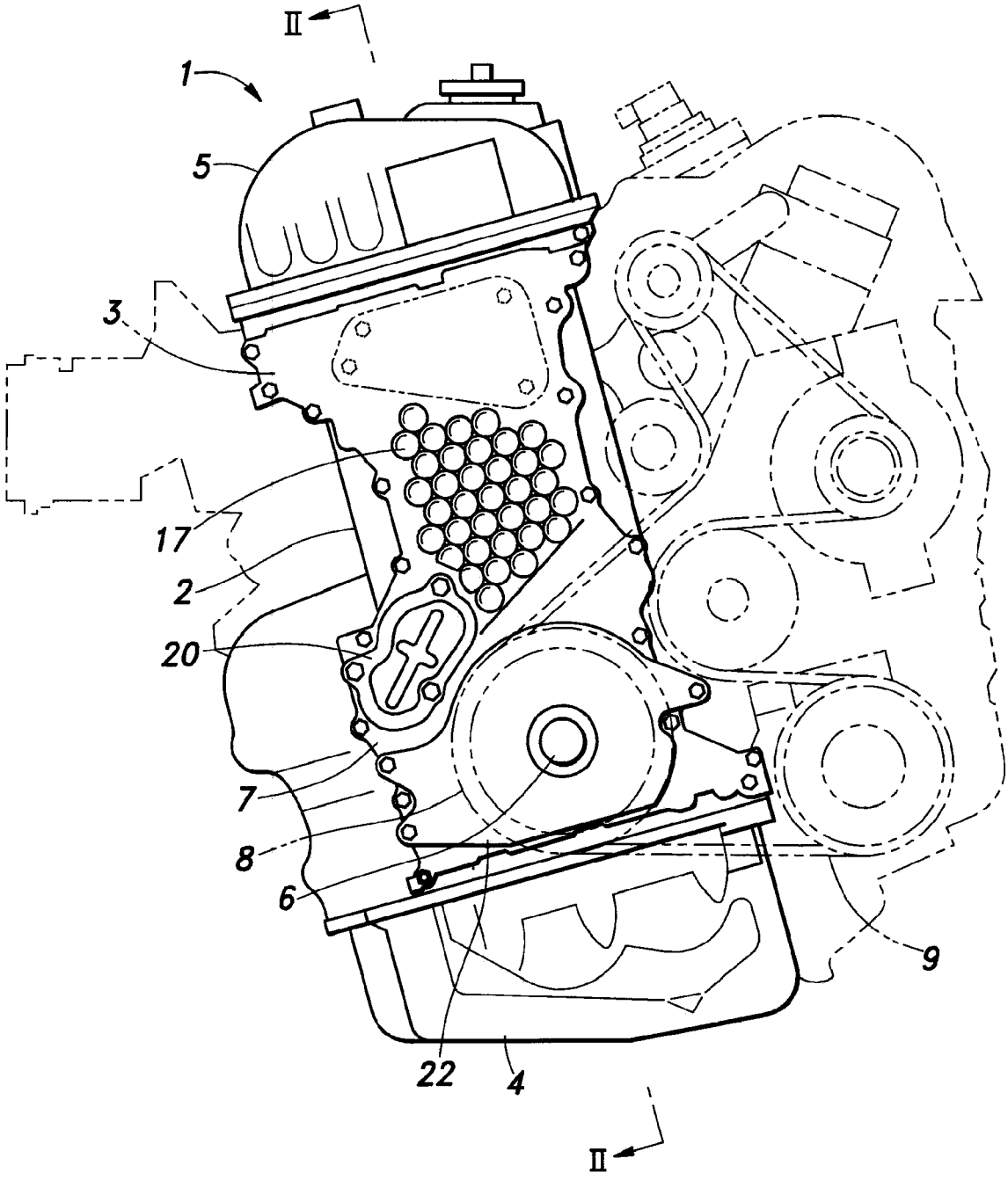
FIG. 1 is a front view showing an engine 1 where the present invention is applied.

Next, an embodiment of the present invention is explained with reference to the attached drawings. FIG. 1 is a front view of an engine 1 where the present invention is applied. In FIG. 1, accessories are illustrated with dotted lines.

The engine 1 is an in-line four-cylinder engine and comprises a cylinder block 2, a cylinder head 3, an oil pan 4 and a head cover 5 like other known engines.

Figure 2:
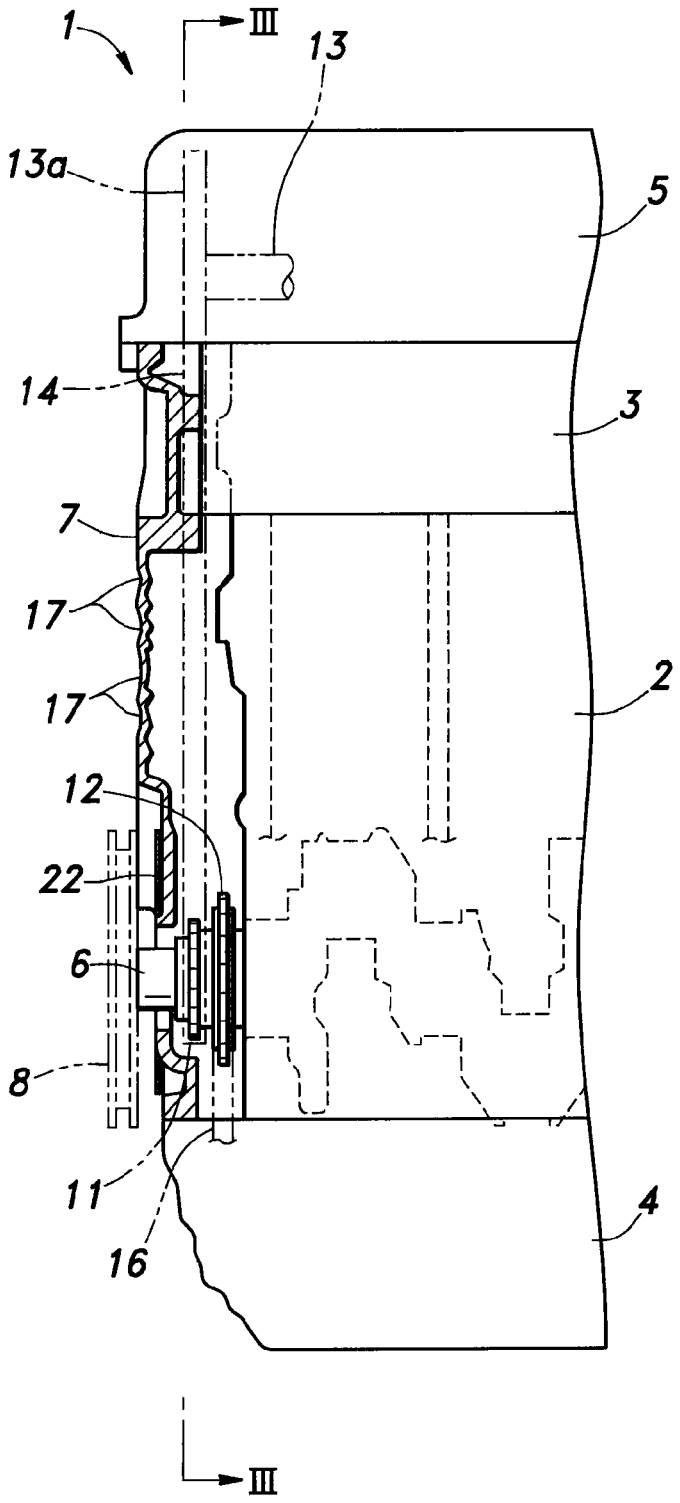
FIG. 2 is a cross-sectional view taken along line II-II of FIG. 1.

As shown in FIG. 2, a chain cover member 7 is provided to an end (frontal part as shown in FIG. 1) of the engine 1 with respect to an axial direction of a crankshaft 6 so as to cover this part of the engine. A crank pulley 8 is fixed to an end of the crankshaft 6, and transmits rotation of the crankshaft 6 to other members via a belt 9 engaged with the crank pulley 8.

Figure 3:
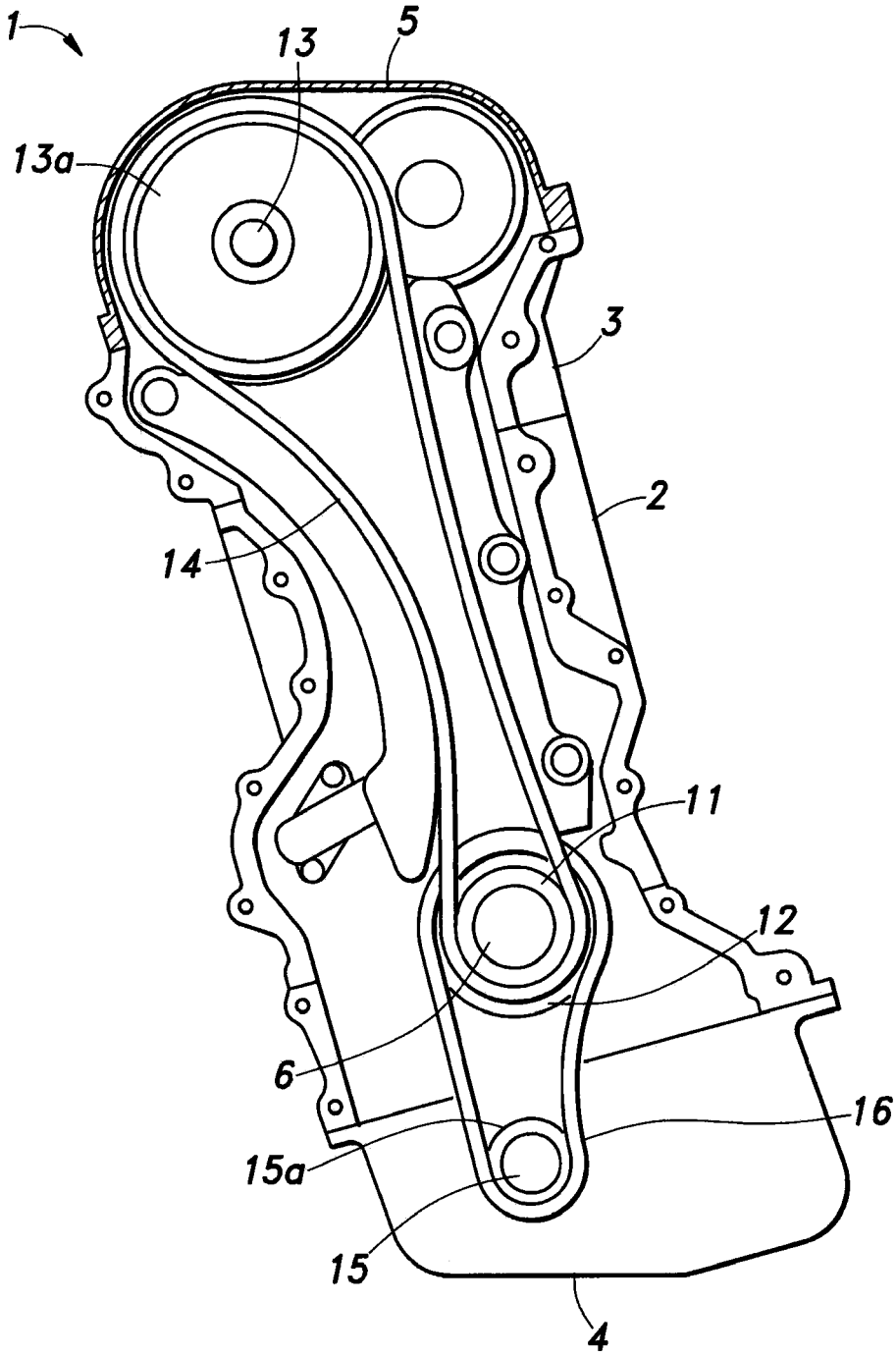
FIG. 3 corresponds to FIG. 1 with the chain cover member being taken off.

In addition, as shown in FIGS. 2 and 3, a smaller sprocket 11 and a larger sprocket 12 are fixed to the crankshaft 6 at a portion between the main body of the engine 1 and the chain cover member 7. The engine 1 has a camshaft 13 disposed inside the head cover 5. The camshaft 13 is provided with a cam-driven sprocket 13*a* fixed thereto. A cam chain 14, an endless power-transmitting member, is engaged with both of the smaller sprocket 11 and the cam-driven sprocket 13*a* so as to transmit the rotation of the crankshaft 6 to the camshaft 13, and a pump driving chain 16 is engaged with both of the larger sprocket 12 and an oil-driven sprocket 15*a* fixed to an oil pump shaft 15 provided to the oil pan 4.

The chain cover member 7 is provided with an opening formed at a desired position. This opening is covered by a chain maintenance cap 20 fixed to the chain cover member 7 by threaded bolts. Therefore, by removing the chain maintenance cap 20, maintenance works such as adjusting the tense of the cam chain 14 can be readily done without removing the entire chain cover member 7.

Next, the chain cover member 7 according to the present invention is explained. The chain cover member 7 is fixed to the cylinder block 2 and cylinder head 3 by threaded bolts at points on its periphery. The axial direction of each of these threaded bolts is parallel to the axial direction of the crankshaft 6.

Figure 4:
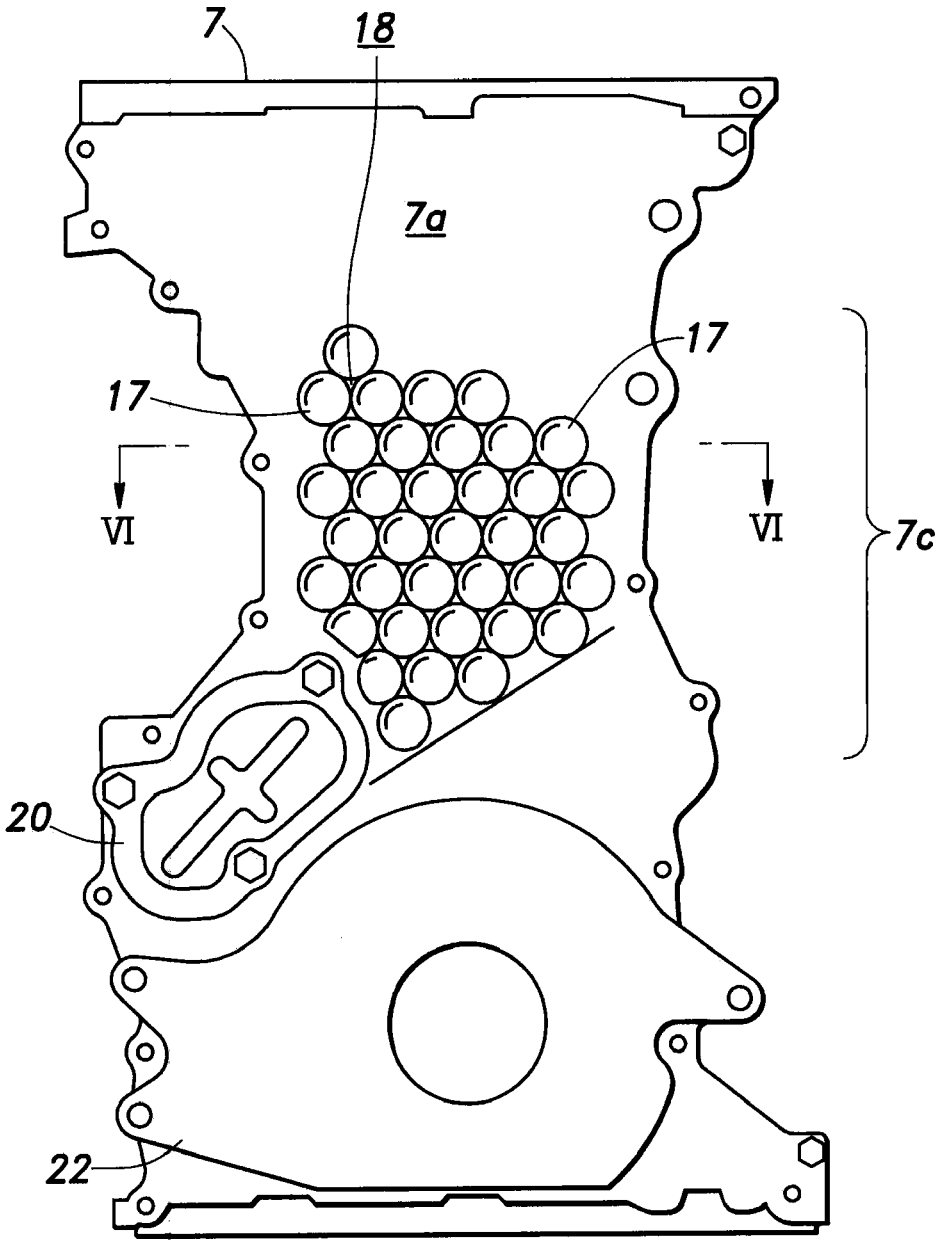
FIG. 4 shows the outer surface of the chain cover member.
Figure 5:
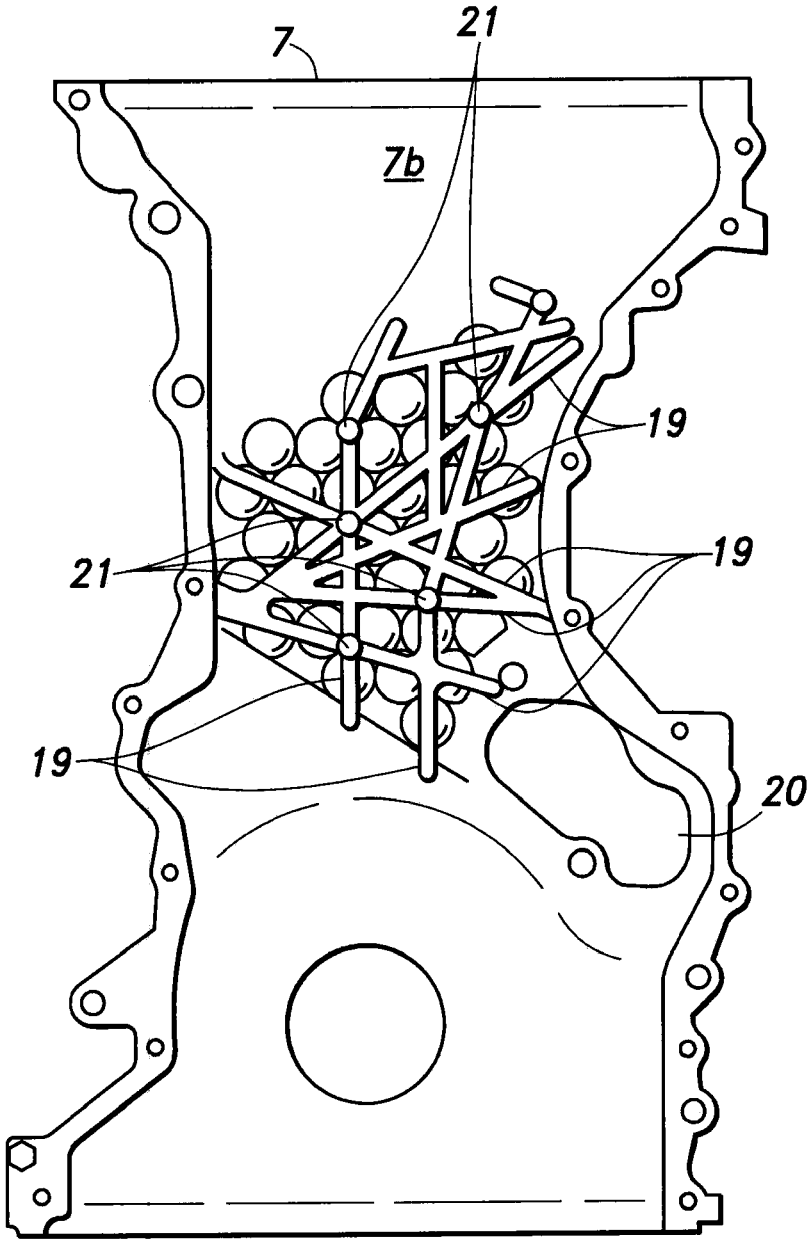
FIG. 5 shows the inner surface of the chain cover member.
Figure 6:
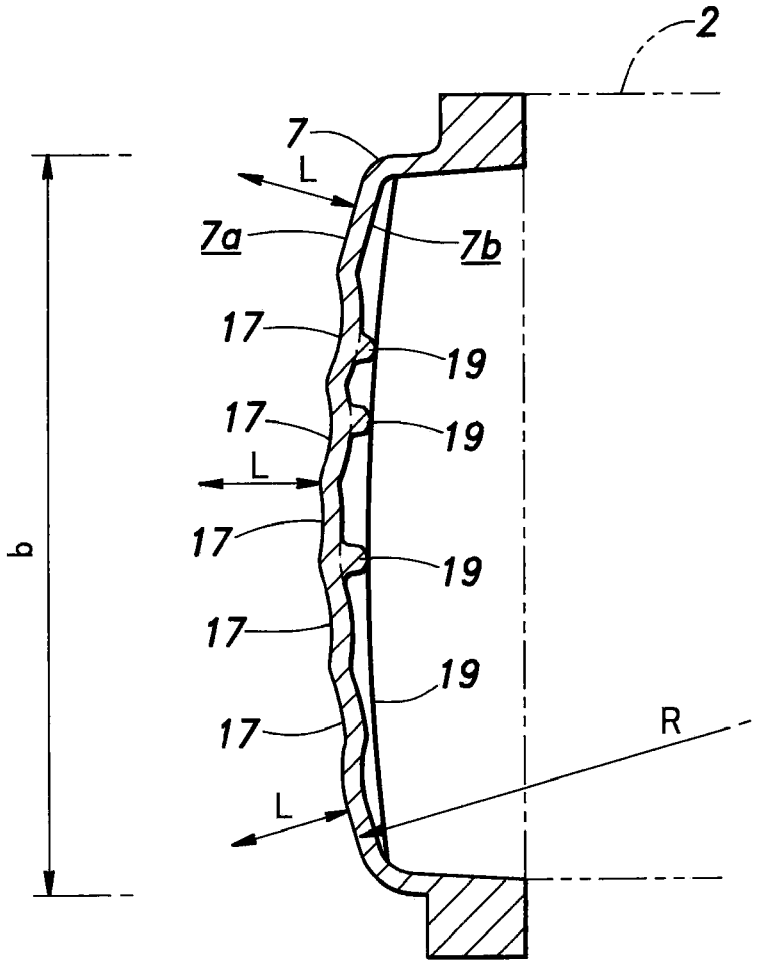
FIG. 6 is a cross sectional view taken along line IV-IV of FIG. 4.

FIG. 4 shows an outer surface 7*a* of the chain cover member 7 facing outward with respect to engine 1, while FIG. 5 shows an inner surface 7*b* of the chain cover member 7 which faces the cylinder block 2 (and the cam chain 14). As shown in these figures, the chain cover member 7 is provided with a plurality of circular compartments 17, each with a circular periphery, defined thereon at its central portion. As shown in FIG. 6, the circular compartments 17 each are defined by a concave surface facing outward and a convex surface facing inward. At least on surface 7*a*, the concave surfaces jointly define a continuous curved surface. The term "continuous curved surface" refers to a surface that consists strictly of curved surfaces that continually adjoin one another without any flat surface interposed between them.

By providing such a continuous curved surface, flat surface (flat portion) on the chain cover member 7 can be reduced, which in turn reduces sound emission from the chain cover member 7, thereby minimizing noises generated by the cam chain 14 and other members. Moreover, as each circular compartment 17 is defined by a concave surface facing outward, there is no projection from the outer surface 7*a* which would be formed if each circular compartment 17 were defined by a convex surface facing outward, and thus a length of the engine 1 in the axial direction of the crankshaft 6 can be reduced. Furthermore, as these concave surfaces do not affect the length of a gap (L of FIG. 6) between the surface 7*a* and other vehicle members (not shown) disposed near the chain cover member 7, it ensures a space necessary for removing the chain cover member 7 during a maintenance work and enables other members to be disposed in proximity to the chain cover member 7 at the same time, thereby contributing to the compact layout of the engine room.

The plurality of circular compartments 17 are defined such that in each three circular compartments 17 adjoining to each other, the three circular compartments 17 are arranged in a triangular pattern, and each circular compartment 17 circumscribes the other two circular compartments 17, and thus the whole circular compartments 17 form a honeycomb pattern. Therefore, the concave surfaces facing outward or convex surfaces of each three circular compartments 17 adjoining to each other can be arranged in the densest pattern, thereby minimizing a surface area of each flat portion 18 surrounded by three circular compartments circumscribing one another. This reduces sound emission from such flat portions of the chain cover member 7, minimizing the entire noise level.

As shown in FIG. 5, the chain cover member 7 is provided with a plurality of ribs 19 on its inner surface 7*b*. Each rib 19 is formed so as to project toward the cam chain 14 and to extend partly across the circular compartments 17 when seen through the outer surface 7*a* or inner surface 7*b*.

Some of the flat portions 18, each surrounded by three circular compartments 17, are each provided with a pushpin boss 21 thereon. These pushpin bosses 21 are provided to enable to remove the chain cover member 7 from a die assembly by pressing pushpins thereon after being made by using the die assembly. As each pushpin boss 21 is provided on a flat portion 18 surrounded by three circular compartments 17 as described above, a load applied from each pushpin will act in a direction in which the pushpin is pressed, thereby enabling the chain cover member 7 to be removed readily from the die assembly.

On the other hand, if each pushpin boss 21 is provided on a concave surface or a convex surface of a circular compartment 17, a load applied from each pushpin would be divided into components acting in directions other than the direction in which the chain cover member 7 is to be removed, and thus it would be difficult to remove the chain cover member 7 from the die assembly. Therefore, by providing each pushpin boss 21 on a flat portion 18 so as to enable the chain cover member 7 to be removed from the die assembly easily, the chain cover member 7 having the circular compartments 17 provided in the above-described arrangement to reduce sound emission can be easily made by an easy forming method using a die assembly.

Some of the ribs 19 extend so as to connect some pushpin bosses 21, thereby reinforcing these pushpin bosses 21 as well as portions around them. This will enhance the stiffness of the chain cover member 7, thereby reducing vibrations of the chain cover member 7, and thus sound emission from the chain cover member 7.

Each rib 19 is formed so as to extend at an angle with respect to a plumb line when the engine 1 is mounted on a vehicle. When oil (lubricant oil) flows down the inner surface 7*b* of the chain cover member 7 or splatters from the cam chain 4, it will get caught by at least one of these ribs 19 easily. As shown in FIG. 5, since each circular compartment 17 is defined by a convex surface facing inward and each rib 19 is provided on the inner surface 7*b* so as to extend across the circular compartments 17, the oil caught on the upper surface of the rib 19 will flow to and over the convex surfaces of the circular compartments 17 to finally drip from the chain cover member 7.

In the absence of convex surfaces facing inward, when oil gets caught on a rib 19 inclined at an angle with respect to the plumb line, it would accumulate thereon easily, and thus oil recovery rate would decrease. In order to prevent this, it would be necessary to limit the extension direction of each rib 19. In this case, if each rib 19 is formed to extend along the plumb line to avoid oil accumulation thereon, it would be difficult to improve the stiffness of the chain cover member 7 by freely designing the arrangement and layout of the ribs 19.

On the other hand, by defining each circular compartment 17 so as to be formed by a convex surface facing inward and providing each rib 19 so as to extend across some of the circular compartments 17, even if there is a rib extending in a horizontal direction, when oil gets caught on such a rib, it will flow to and over the convex surfaces of the circular compartments 17 to finally drip into the oil pan 4, and thus reduction in oil recovery in the oil pan 4 can be prevented. Therefore, the ribs 19 can be arranged in various directions including horizontal direction without limit in order to improve the stiffness of the chain cover member 7, thereby reducing vibrations and sound emission. By providing the ribs 19 such that their upper surfaces are directly connected with the convex surfaces of the circular compartments 17 facing inward, the accumulation of oil on the ribs 19 can be reduced more significantly.

As shown in FIG. 6, a wall of the chain cover member 7 defining each circular compartment 17 is formed to have a uniform thickness. If each of these walls of the chain cover member 7 becomes nonuniform in thickness with some parts having a larger thickness than others as a result of forming concave surfaces or convex surfaces, the weight of the cover member 7 may increase. Therefore, such a uniform thickness contributes to the weight reduction of the chain cover member 7. This also prevents partial strength deterioration of the chain cover member 7, and thus enhances the reduction of vibrations and noises.

In addition, as shown in FIG. 6, the outer surface 7*a* of the chain cover member 7 facing outward with respect to the engine 1, is provided with a curved part (almost corresponds to region 7*c* in FIG. 4) that is curved outward and substantially across an entire width of the cover member 7. This curved part provides the surface 7*a* of the chain cover member 7 with a higher stiffness and reduces sound emission more significantly compared to when it is formed to be flat. In addition, by forming the circular compartments 17 on the curved part 7*c*, sound emission can be reduced even more. The curved part 7*c* is formed such that it curves laterally in a direction perpendicular to a longitudinal direction of the surface 7*a* (i.e. axial direction of cylinders) at a radius of curvature (R in FIG. 6) greater than the width (b in FIG. 6) of the chain cover member 7 (i.e., R>b) so that it curves mildly. By configuring the curvature radius R to be larger than the width b of the chain cover member 7, the stiffness of the chain cover member 7 can be improved while maintaining the degree of outward protrusion of surface 7*a* low.

In addition, damping plates 22, which are laminated steel plates, are fixed by threaded bolts to the surface 7*a* of the chain cover member 7 so as to surround a portion of the chain cover member 7 where the end of the crankshaft 6 protrudes. Therefore, the damping plates 22 reduces vibrations of the chain cover member 7 due to friction generated between them, and thus effectively reduces sound emission from the chain cover member 7.

In this embodiment, although all of the circular compartments 17 are defined by concave surfaces facing outward, they may be defined by convex surfaces facing outward, or they may be defined by a combination of concave surfaces and convex surfaces, both facing outward. Alternatively, the chain cover member 7 may be provided with concave surfaces facing outward, while the inner surface 7*b* is formed to be flat. In either case, the area of flat surface (flat portion) of the chain cover member 7 decreases, thereby reducing sound emission.

The present invention can also be applied to engines of boats having crankshafts extending vertically.

The invention claimed is:

1. A cover member configured to be fixed to an engine to cover an endless power transmitting member transmitting rotation of a crankshaft to a driven shaft, comprising multiple circular compartments defined in a wall of the cover member, wherein the multiple circular compartments each consist of a concave surface facing outward from said engine and a convex surface facing inward toward said engine jointly defining a continuous curved surface, and include at least three circular compartments tangential to one another; and a rib provided on an inner surface of the wall of the cover member so as to extend across at least two of the multiple circular compartments, wherein the upper surface of said rib is directly connected with the convex surfaces of the circular compartments facing inwards.

2. The cover member according to claim 1, wherein the rib extends at an angle with respect to a plumb line when the engine is mounted on a vehicle.

3. The cover member according to claim 1, wherein the multiple circular compartments include at least three circular compartments which circumscribe one another.

4. The cover member according to claim 3, wherein the cover member is made by using a die assembly and further comprises a pushpin boss on a portion surrounded by the at least three circumscribing circular compartments for removing the cover member from the die assembly.

5. The cover member according to claim 1, wherein the wall of the cover member defining each of the multiple circular compartments has a uniform thickness.

6. The cover member according to claim 1, wherein the outer surface of the cover member facing outward with respect to the engine is provided with a part that is generally curved substantially laterally across an entire width of the cover member at a radius of curvature greater than the width of the cover member, and the multiple circular compartments are formed in the generally curved part of the cover member.

7. The cover member according to claim 6, wherein the wall of the cover member defining each of the multiple circular compartments has a uniform thickness.

8. The cover member according to claim 6, wherein the multiple circular compartments include at least three circular compartments which circumscribe one another.

9. The cover member according to claim 8, wherein the cover member is made by using a die assembly and further comprises a pushpin boss on a portion surrounded by the at least three circumscribing circular compartments for removing the cover member from the die assembly.

10. A cover member configured to be fixed to an engine to cover an endless power transmitting member transmitting rotation of a crankshaft to a driven shaft, comprising:

multiple circular compartments defined in a wall of the cover member, wherein the multiple circular compartments each consist of a concave surface facing outward from said engine and a convex surface facing inward toward said engine, and the concave surface of each circular compartment directly abuts against the concave surface of a neighboring circular compartment to define a continuous curved surface; and wherein the multiple circular compartments include three circular compartments arranged in a triangular pattern and adjoining one another, and wherein the cover member is made by using a die assembly and further comprises a pushpin boss provided on a flat portion surrounded by and abutting the three adjoining circular compartments for removing the cover member from the die assembly.

* * * * *